US005477566A

United States Patent [19]

Massman

[11] Patent Number: 5,477,566

[45] Date of Patent: Dec. 26, 1995

[54] HELMET VISOR MECHANISM WITH LATERALLY MOVEABLE VISORS

[75] Inventor: John C. Massman, San Diego, Calif.

[73] Assignee: Tricel Corporation, San Diego, Calif.

[21] Appl. No.: 384,961

[22] Filed: Feb. 7, 1995

[51] Int. Cl.[6] ..... A42B 3/22

[52] U.S. Cl. ..... 2/424; 2/422

[58] Field of Search ..... 2/9, 6.3, 6.4, 6.7, 2/410, 411, 422, 424, 15, 425, 427, 438, 10

[56] References Cited

U.S. PATENT DOCUMENTS

| | | | |
|---|---|---|---|
| 3,577,563 | 5/1971 | Raschke | 2/8 |
| 3,946,442 | 3/1976 | Wallander | 2/9 |
| 4,042,974 | 8/1977 | Morgan | 2/9 |
| 4,136,403 | 1/1979 | Walther | 2/10 |
| 4,138,746 | 2/1979 | Bergmann | 2/424 |
| 4,222,123 | 9/1980 | Hellberg | 2/10 |
| 4,428,081 | 1/1984 | Smith | 2/422 |
| 4,542,538 | 9/1985 | Moretti et al. | 2/422 |
| 4,581,776 | 4/1986 | Kie | 2/425 |
| 4,748,697 | 6/1988 | Hodnett | 2/438 |
| 5,163,185 | 11/1992 | Hodnett | 2/424 |
| 5,212,843 | 5/1993 | Kamata | 2/424 |

*Primary Examiner*—Michael A. Neas

*Attorney, Agent, or Firm*—Knobbe, Martens, Olson & Bear

[57] ABSTRACT

A helmet visor mechanism with laterally moveable visors that move on guides attached to the helmet. The helmet may contain a single visor or multiple visors. The visors may be clear or tinted to enable the wearer the ability to adapt to a variety of lighting conditions without removing the helmet or exposing the facial area. In the preferred embodiment, the visors may be stored and protected either within the helmet casing or in an external casing. In an additional embodiment, the visors and guides will define a visor cartridge. When all the visors are retracted, the wearer's facial area will be exposed.

29 Claims, 4 Drawing Sheets

HELMET VISOR MECHANISM WITH LATERALLY MOVEABLE VISORS

FIELD OF THE INVENTION

This invention relates to visors for helmets such as motorcycle helmets, sports helmets, safety helmets, crash helmets and face protectors.

BACKGROUND OF THE INVENTION

Conventional helmets employ a hard shell casing which envelopes the back, crown and sides of a wearer's head. The majority of these helmets have some type of resilient padding inside to cushion a blow to the helmet. Many types of helmet shapes are known in the art. Some helmets cover the wearer's mouth and chin, while other types of helmets leave this area completely open.

Most helmets employ some type of mechanism for shielding the wearer's eyes from the outside environment. For example, some motorcycle helmets have visors that protect the wearer from wind and rain. These visors are commonly moveable. One method of attaching these visors has been to hinge them on pivot points located on the sides of the helmet. The visor can then pivot vertically to selectively expose or cover the facial area. Alternative methods of attachment include visors which slide vertically on tracks on opposite sides of the eye area of a wearer's face.

Pertinent patents relating to vertically moveable visors are U.S. Pat. No. 4,222,123, dated Sep. 16, 1980 to A. Hellberg and U.S. Pat. No. 4,581,776 dated Apr. 15, 1986 to H. Kie. When a vertically movable visor is raised while riding, the angle at which the lower edge of the visor contacts the wind is changed, thereby changing the wind force impacting directly on the visor. This change in force may add torque to the visor which causes fatigue to the neck muscles.

The Hellberg patent discloses a visor for a helmet that attaches to a pivoting arm attached above each ear of the wearer and extending to a point above each temple of the wearer. The visor is designed to pivot vertically on a hinge, selectively exposing or covering the wearer's face. While in the up position, the wearer's face is exposed and the visor remains exposed to the elements. Only one visor may be installed at a time, thereby requiring the wearer to choose between a tinted or clear visor when the helmet is first put on. No mechanism is provided to change the tint of the visor while wearing the helmet and no lateral movement of the visor is disclosed.

In the Kie patent, a visor is disclosed that slides vertically on tracks attached at each earguard of the helmet. The visor can be moved only in the vertical plane. A set of tracks is installed surrounding the wearer's earguards. When the visor is being raised, it moves along these tracks to reach the up position. When the visor is in the up position, the wearer's facial area and the visor are exposed to the elements. Also, because the tracks disclosed surround the ear in semicircular manner, the visor may only move along the tracks up or down in the vertical plane. No lateral movement can be achieved.

Some types of laterally moveable visor mechanisms have been implemented on helmets and the like with transparent film contained in canisters. These canisters are attached vertically to the exterior of the hard shell casing of the helmet at the side areas of the wearer's field of view. The helmets may be with or without a fixed visor behind the transparent film fed by the canisters. Pertinent patents relating to such mechanisms are U.S. Pat. No. 3,946,442, dated Mar. 30, 1976 to B. O. H. Wallander, U.S. Pat. No. 4,748,697, dated Jun. 7, 1988 to J. L. Hodnett and U.S. Pat. No. 5,163,185 dated Nov. 17, 1992 to J. L. Hodnett. These patents are all directed to devices embodying a transparent film located on the external surface of the helmet device, which can be placed over a permanent visor. None of the prior art allows lateral storage of visors in the side and rear areas of the helmet, or permits the wearer to selectively choose between a tinted or clear visor stored in the helmet.

The Wallander patent discloses a helmet in which a film may be slid across a curved transparent plate. Attached to each side edge of the helmet adjacent the earguards are mounted canisters for holding the film. One canister is a supply roll and the other is a take up roll. When the film covering the transparent plate receives sight restricting deposits the user actuates the driven take-up roll to draw the dirty film section out of the field of sight and introduce a fresh film section into the field of sight. There is no provision for the film to move both forward and backward. Also, this invention does not allow movement of the curved transparent plate, and thus does not allow either exposing the wearer's facial area or rapidly changing to a tinted visor.

The Hodnett patents disclose a face mask having a supply roll of transparent, flexible film that can be unrolled along a track extending across the mask. The supply roll is enclosed in a canister attached to the side of the mask, adjacent to the wearer's temple. If the film portion extending across the mask becomes dirty or scratched, the wearer can grip the end of the film and unroll additional film to replace the dirty or scratched portion. The wearer then tears the dirty or scratched portion off and discards it. There is no provision disclosed allowing movement of the film in either direction. The Hodnett '185 patent discloses the additional feature of inserting a tinted window behind the transparent film across the mask. The tinted window cannot, however, be slid between this position and a retracted position, rather it can only be inserted or removed.

While these implementations disclose lateral movement of film across the visor area, none of the prior art discloses an implementation of a laterally moveable visor.

Helmet wearers are currently unable to change visors quickly or to switch between a clear visor, a tinted visor, or an open facial area without changing the wind force acting on the visor. The need also exists to allow a wearer to change visors without exposing the facial area. Many of the visor mechanisms disclosed in the prior art involve complicated gearing mechanisms. For a device such as a helmet, a complicated mechanism may prove to be cost prohibitive. Consequently, what is needed in the art is a simple technique that allows a helmet wearer to choose between multiple visors, providing ready availability of both tinted and clear visors, without exposing the facial area to the outside environment. Also, to ensure a longer life, it would be an improvement in the art to provide an arrangement for protecting the visors from exposure to the elements when not in use.

SUMMARY OF THE INVENTION

The present invention is a visor mechanism with one or more laterally moveable visors that fit into or on a helmet. According to this invention, the wearer of the helmet may alternate visors by moving the current visor along guides away from the face area. A second visor, that is stored in the helmet, may then be moved over the face area. This will allow changing the visor from clear to tinted, for example. Any two combinations of colors may be used. Both visors may also be stored in the guides along the side and rear areas of the helmet to allow an open facial area. The visors may also be moved simultaneously to allow changing the visor in use without exposing the facial area to the elements.

Moving the visors laterally instead of vertically provides several advantages. As previously stated, in a vertically moving visor, when the visor is raised while riding the angle at which the lower edge of the visor contacts the wind is changed, thereby changing the wind force impacting directly on the visor. This change in force may add torque to the visor which causes fatigue to neck muscles. By implementing lateral movement, the present invention maintains a constant angle of the visor's edge with the oncoming wind force. By maintaining this angle, the present invention reduces the possibility of a wind force catching underneath the visor. The wind force on the laterally moving visor remains substantially constant whether opening or closing the visor.

Another advantage to laterally moving visors is that the clear and tinted visors may be moved simultaneously, thereby maintaining protection of the face at all times. In the current vertically movable visors, one visor must be fully raised before another may be lowered in place. This leaves a period of time when the facial area is left exposed. With the laterally moving visor, the second visor may be moved along the guides to cover the face at the same time as the first visor is being moved into a retracted position.

A unique feature of laterally moving visors is that any visor not in use will be protected inside the helmet, thereby preventing scratching and increasing the life of the visors. Because the visor not in use has been moved to the side and rear of the helmet, the hard shell casing of the helmet acts as a shield to protect the visor. For an externally mounted visor, a hard shell casing similar to the exterior of the helmet can be mounted on the helmet for visor storage.

Tabs are added to the leading edge of each visor to assist in the movement of the visors from the closed position to the retracted position. In one preferred embodiment, the tabs are located on the lower portion of the leading edge of the visors. By placing the tabs on the lower portion of the visors, the wearer of the helmet can open or close the visors without obstructing his or her field of vision with their hand or arm. The tabs also allow the visors to be moved without the wearer physically touching the visors, thereby assisting in keeping the visors clean. By placing the tabs on the leading edge of each visor, the tabs may be gripped together allowing both visors to be moved with one hand. This allows the visors to be moved simultaneously, thereby changing visors without exposing the facial area to the external environment.

DETAILED DESCRIPTION OF THE PREFERRED EMBODIMENTS

Figure 1:
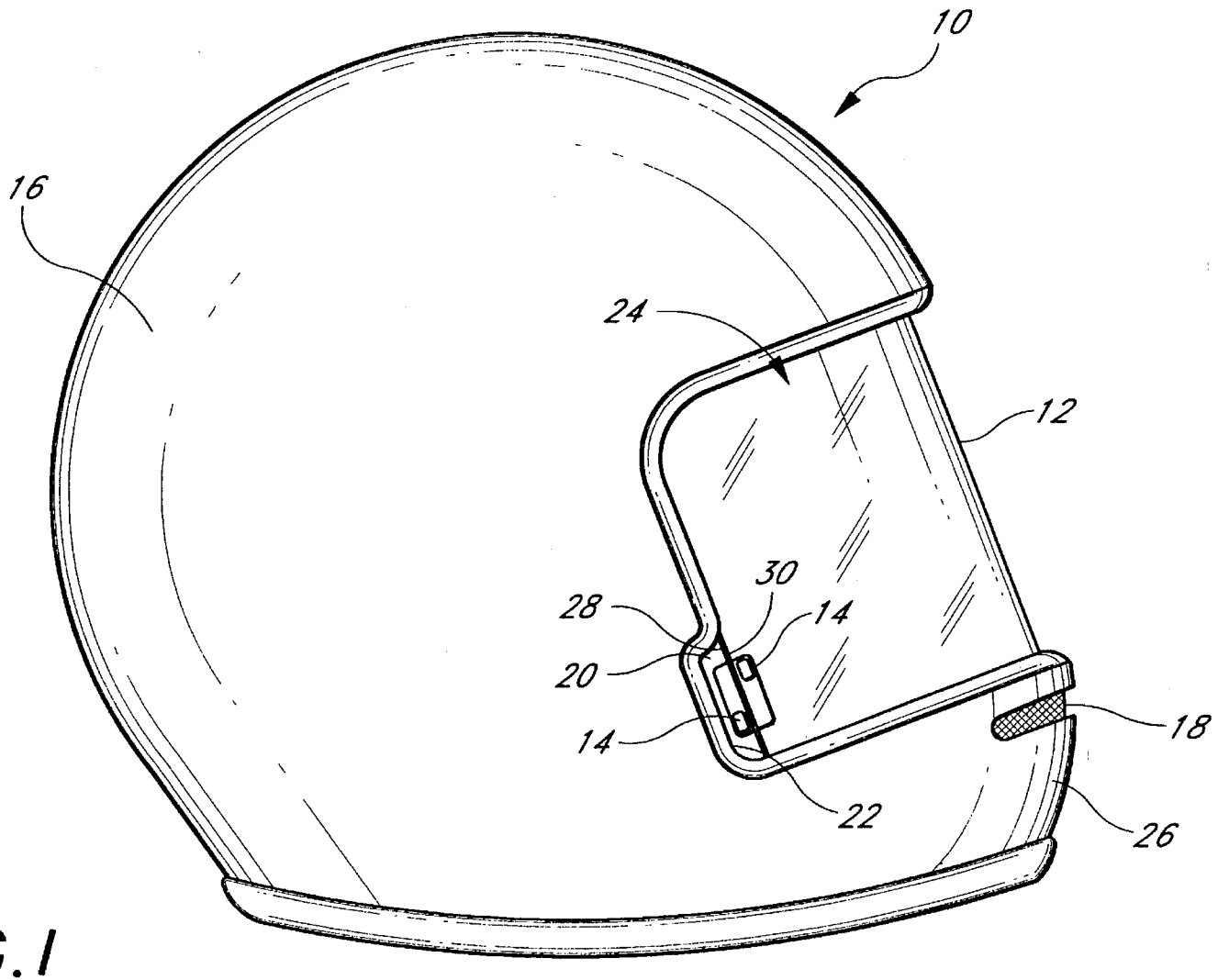
FIG. 1 is a side view of a helmet according to the invention.

FIG. 1 illustrates a protective helmet 10 having a hard casing 16 designed to wrap around and protect the human head. A clear visor 12 is shown covering the face opening 24, thereby protecting the eyes, nose and mouth area of the face. An edge 28 of a tinted visor 20 can be seen extending from a side opening 22 of the hard casing 16. The side opening 22 also allows a majority of the joining edges 30 of the visors, 12 and 20, to be covered by the hard casing 16. A tab 14 is connected to the leading edge of the tinted visor 20 to assist in moving the tinted visor from a retracted position inside the helmet to a closed position covering the face opening 24, protecting the eyes, nose and mouth area of the face. Tab 14 acts as a stop guide to prevent the tinted visor 20 from being pushed too far inside the hard casing 16. An air vent 18 is shown installed in a chin protector 26 to allow air exchange between inside and outside the helmet to prevent fogging of the visor 12.

During operation of the visors 12 and 20, the wearer grips the tabs 14 and moves the clear visor 12 back into the hard casing 16 of the helmet 10. By selectively gripping one or two tabs 14, the wearer may either move only the clear visor 12, or may move both the clear visor 12 and the tinted visor 20. If only the clear visor 12 is moved, the result will be to expose the wearer's facial area. If both tabs 14 are gripped, as the clear visor 12 is pushed across the face opening 24, the tinted visor 20 is maintained in contact with the clear visor 12 and is also drawn across the face opening 24. This prevents exposure of the wearer's facial area while the visor covering the face opening 24 is being changed. The visors 12 and 20 may then be moved in the reverse direction to retract the tinted visor 20 and expose the clear visor 12.

Figure 2A:
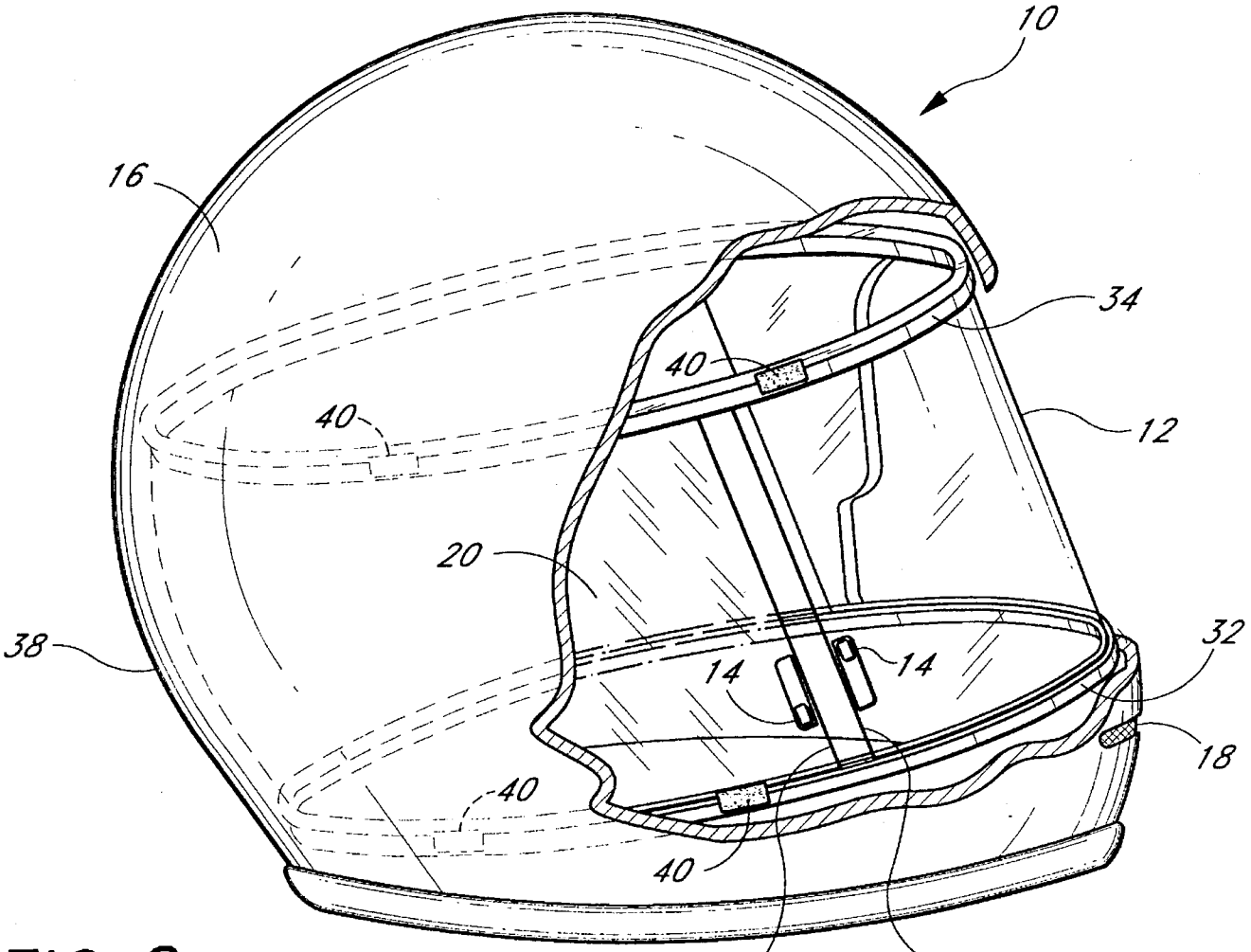
FIG. 2*a* is a perspective view of the helmet of FIG. 1, with a portion thereof removed to reveal the visors contained in the helmet.

FIG. 2*a* shows the clear visor 12 extending across most of the face opening and the tinted visor 20 retracted in the hard casing 16 of the helmet 10. The visors, 12 and 20, are mounted between a bottom guide 32 and a top guide 34. The guides, 32 and 34, may be implemented in a number of embodiments. In the preferred method, the guides, 32 and 34, are comprised of a flexible plastic material and extend in parallel configuration adjacent to the upper and lower edges of the facial opening 24 and within the body of hard casing 16 so as to connect in the rear portion of hard casing 16. Within a bottom face of guide 34 and a top face of guide 32 are U-shaped grooves 33 which extend the entire length of their respective guides 32 and 34 and are configured so as to face each other. The visors, 20 and 12, fit inside the grooves formed by the top guide 34 and the bottom guide 32. In one preferred embodiment, the guides, 32 and 34, are attached to the hard shell casing 16 by placing VELCRO® hook and loop fastener strips 40 along the guides, 32 and 34, and corresponding VELCRO® hook and loop fastener strips on the inside of the hard casing 16 of the helmet. However, any method of attachment of the guides, 32 and 34, can be used without changing the spirit of the invention. The main requirement is to hold the visors, 12 and 20, and to allow lateral motion.

When either visor, 20 and 12, gets scratched or soiled, the guides 32 and 34 can be removed so the visor may be replaced. With the guides 32 and 34 removed, either visor 20 or 12 can be removed and a new visor may be inserted. The guides 32 and 34 are then reinstalled using the VELCRO® hook and loop fastener strips 40 to hold the visor in place.

The wearer can grasp a tab 14 and retract the clear visor 12 completely inside the hard casing 16 of the helmet 10. The edge 28 (FIG. 1) will act as a stop when contacting tab 14. When retracted, the visor is protected from any normal hazard such as scratching or road grime. Both the clear visor 12 and the tinted visor 20 may be in the retracted position at the same time. When both the clear visor 12 and the tinted visor 20 are retracted, the facial opening 24 of the helmet will be exposed.

Figure 2B:
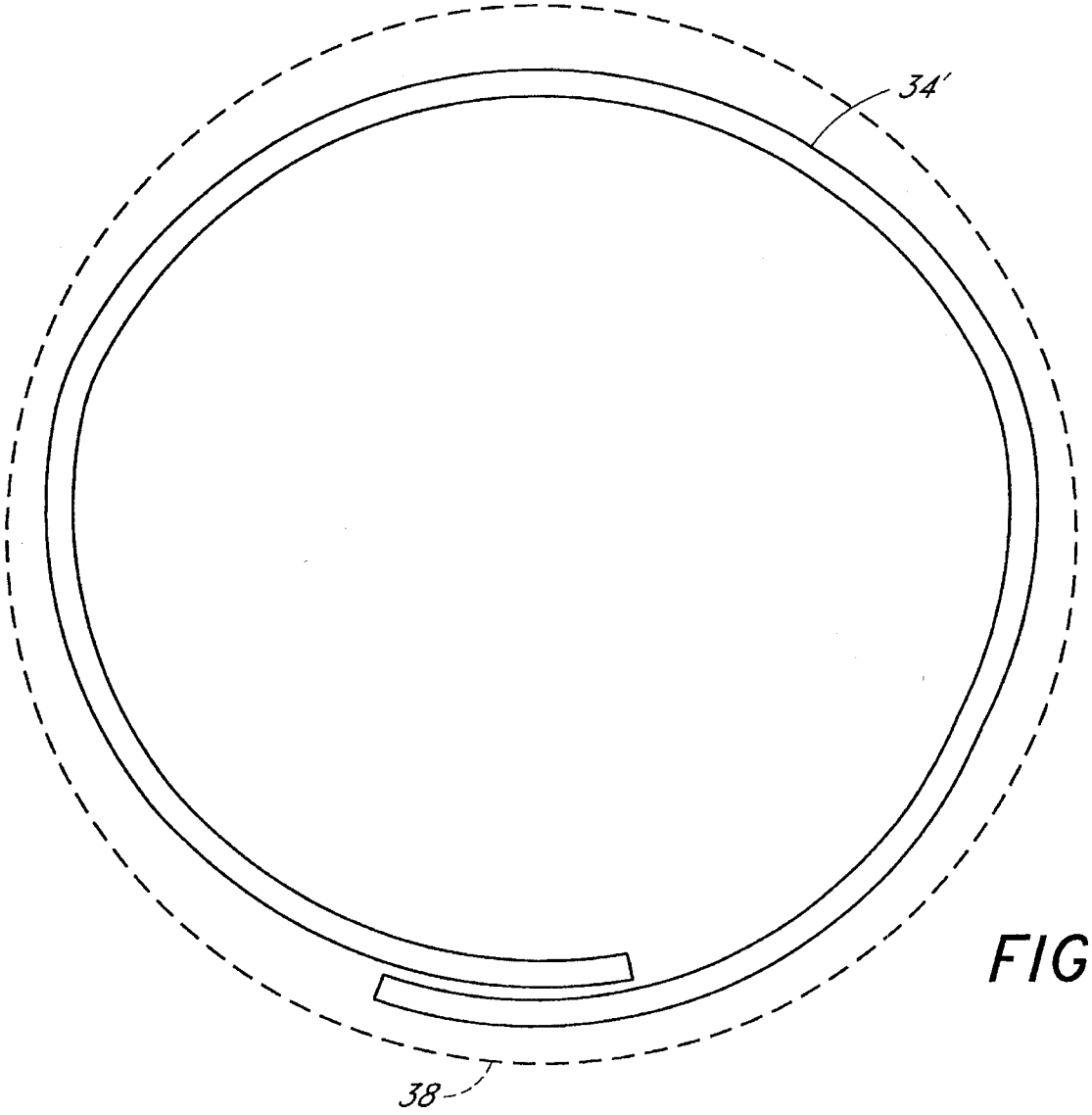
FIG. 2*b* is a top view of one preferred embodiment of a guide for use in the present invention.

To ensure the facial opening 24 is fully exposed when both the clear visor 20 and the tinted visor 20 are retracted, the guides, 32' and 34', may overlap themselves at the rear edge 38 of the helmet 10, as illustrated in FIG. 2*b*. Overlapping guides may be necessary if the helmet size is not large enough to fit both visors, 20 and 12, into the sides and back of the hard shell casing 16.

The invention may also be installed on a helmet 10 without a chin protector 26 (FIG. 1). Without the chin protector 26, no air vent 18 (FIG. 1) is required. In this embodiment, the bottom guide 32 does not extend into the front of the helmet 10. The portion of the clear visor 12 or tinted visor 20 that extends to cover the face opening 24 runs along the top guide 34. When either visor 12 or 20 is retracted, the visors will be fully enclosed with the top guides 34 and the bottom guide 32. This may also be achieved without the use of a bottom guide 32 as will be discussed below.

Figure 3:
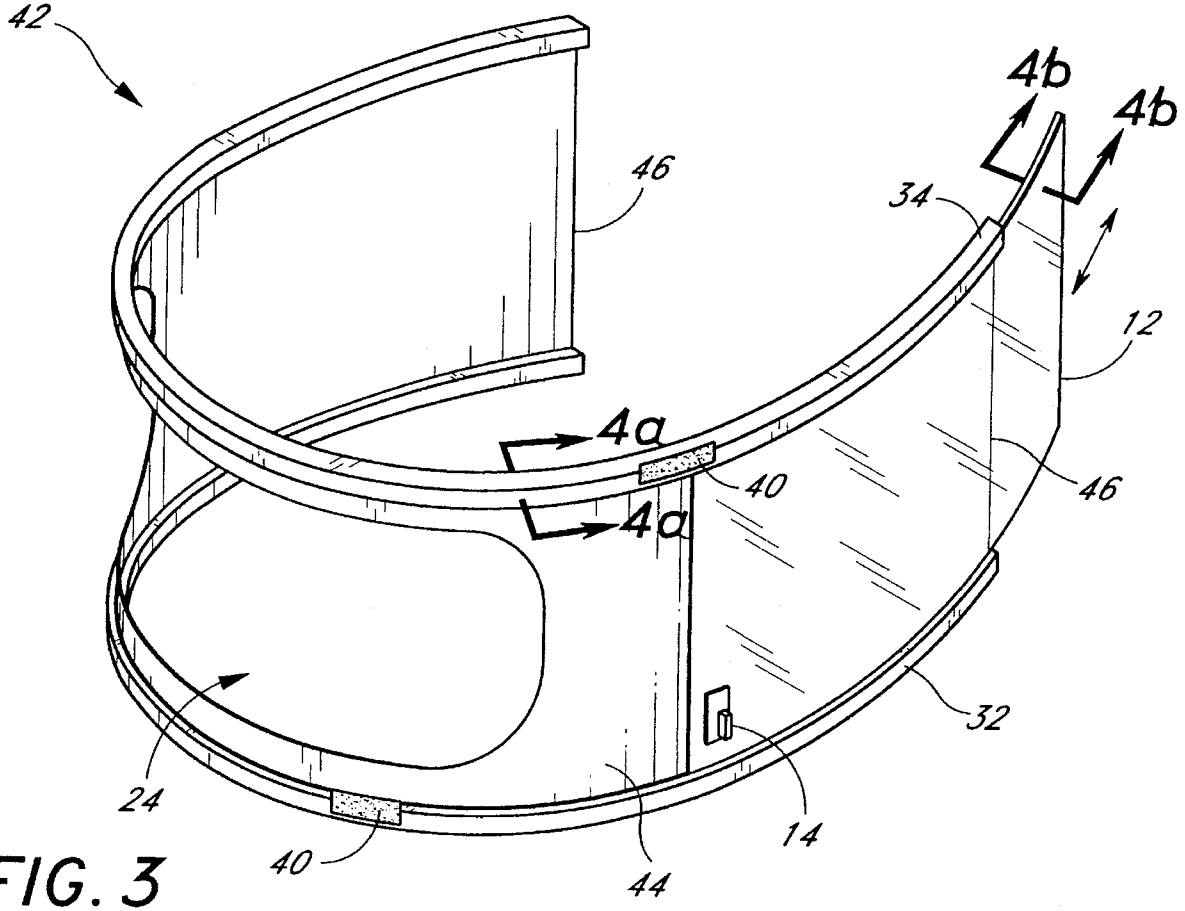
FIG. 3 is a view of a visor cartridge assembly for use in one preferred embodiment of the present invention.

FIG. 3 shows an embodiment of a visor cartridge 42 which may be used with the present invention. The visor cartridge 42 consists of a top guide 34, a bottom guide 32 and a cartridge wall 44. The guides, 32 and 34, are mounted proximate the cartridge wall 44 so that the grooves formed by the guides will be forward of the cartridge wall 44. A visor 12 may be inserted or removed from the cartridge 42 by sliding the visor in or out of the cartridge 42 from between the guides, 32 and 34. The cartridge 42 has a facial opening 24 that corresponds to the facial opening of the helmet 10. In the preferred embodiment, the cartridge 42 is made of a flexible plastic material. This flexible material allows the cartridge 42 to bend when inserted into the helmet 10 to conform to the shape of the helmet 10. When the cartridge 42 bends to fit into the helmet 10, the guide edges 46 may overlap at the rear of the visor cartridge 42 as shown in FIG. 2*b* to ensure the facial opening 24 is fully exposed when the visors, 12 and 20, are retracted.

The top guide 34 and bottom guide 32 are attached together by the cartridge wall 44 to allow removal of the entire visor cartridge 42 from the helmet 10. Once the visor cartridge 42 has been removed from the helmet 10, the visors, 12 and 20, can be removed by sliding the visors from between the guides, 32 and 34. Replacement visors can then be inserted in the cartridge 42 by placing a new visor between the guides, 32 and 34, then moving the visor forward along the guides until the visor is contained in the cartridge 42. This allows simple replacement of the visors, 12 and 20, when they become scratched or soiled.

One method of attachment of the visor cartridge 42 to the hard casing 16 is to have VELCRO® hook and loop fastener strips 40 installed along the guides, 32 and 34, and inside the hard shell casing 16 of the helmet. This will allow quick removal and installation of the visor cartridge 42. Any method of attachment that allows for quick installation or removal of the visor cartridge 42 may be used without changing the essence of the invention.

The visor cartridge 42 can be mounted inside the hard casing 16 as described above. The visor cartridge 42 may also be integral to the hard casing 16, or an externally mounted casing may be installed. In an integral mounting, an area to install the visor cartridge 42 is manufactured into the hard casing 16 of the helmet 10. In an external mount, an additional external casing is attached to the hard casing 16 of the helmet. This additional external casing surrounds the sides and back of the helmet 10 beginning at one side opening 22 and extending to the opposite side opening. The visor cartridge 42 is mounted inside the additional external casing such that the visors, 12 and 20, when retracted are between the hard casing 16 and the additional external casing. In any embodiment, the visors 12 and 20 will be completely covered when the facial opening 24 is exposed.

Figure 4B:
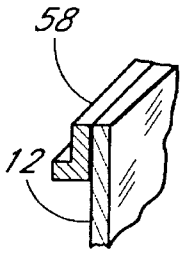
FIG. 4*b* is a partial perspective sectioned view of one preferred embodiment of a visor for use in a single guide embodiment of the present invention.
Figure 4A:
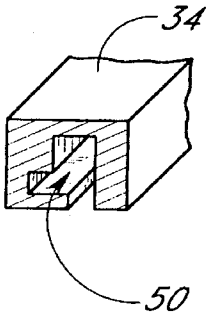
FIG. 4*a* is a partial perspective sectioned view of one preferred embodiment of a guide for use in a single guide embodiment of the present invention.

Both the implementation of the guides attached to the helmet casing 16 as shown in FIG. 2*a* and the visor cartridge 42 in FIG. 3 may be accomplished without the use of the bottom guide 32. In this embodiment, the top guide 34 will be required to support the entire visor 12. As shown in FIG. 4*a*, one method of implementing this single guide configuration is to provide a top guide 34 configured to form a L-shaped groove 50. In FIG. 4*b*, a separate, corresponding L-shaped piece 58 is shown attached to the visor 12. The L-shaped piece 58 may either be molded to the visor during manufacture or attached by a method such as gluing. The visor 12 can then be slid into the top guide 34. The visor 12 will be supported in the top guide 34 by the combination of the L-shaped groove 50 and the L-shaped piece 58.

Of course, numerous variations and modifications of the invention will become readily apparent to those skilled in the art. Accordingly, the scope of the invention should not be construed as limited to the specific embodiment depicted and described but rather, the scope is defined by the appended claims. The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A helmet comprising:

a solid protective member that covers the top and sides of a human head, wherein said protective member has a facial opening, a top portion a back portion, an interior, an exterior, and side portions;

a front pair of guides affixed to the protective member extending along said opening;

at least one side guide extending laterally around at least one side portion of said protective member; and a visor mounted to said front and side guides so as to be laterally moveable along said guides back and forth between retracted and closed positions, wherein said visor covers said facial opening when laterally moved to said closed positions said side guide extending a sufficient distance around said protective member to permit said visor to be moved there along substantially out of said facial opening

2. The helmet according to claim 1 wherein the side guide extends within the interior of at least one side portion of said solid protective member.

3. The helmet according to claim 1 wherein the side guide extends around the exterior of at least one side portion of said solid protective member.

4. The helmet according to claim 1 wherein the guides are integrated into said solid protective member.

5. The helmet according to claim 1 wherein said visor is tinted.

6. The helmet according to claim 1 wherein said visor has a gripping member for assistance in laterally moving the visor.

7. The helmet according to claim 1 wherein the side guide extends into the side and rear portions of the protective member and the visor is moveable along the side guide into the side and rear portions of the protective member.

8. The helmet according to claim 1 wherein the guides and visor define a visor cartridge.

9. The helmet according to claim 8 wherein the visor cartridge is removable from the helmet.

10. The helmet according to claim 8 wherein the visor is removable from the visor cartridge.

11. The helmet according to claim 1 wherein a plurality of visors are associated with the guides.

12. The helmet according to claim 11 wherein only one of said plurality of visors covers the entire facial opening at a time.

13. The helmet according to claim 11 wherein at least one of the plurality of visors has a gripping member to assist in producing lateral movement of said at least one visor.

14. The helmet according to claim 13 wherein the plurality of visors have gripping members configured to assist in producing substantially simultaneous lateral movement of portions of at least 2 visors across the facial opening.

15. The helmet according to claim 11, wherein one of said visors is clear and another of said visors is tinted.

16. The helmet according to claim 11 wherein the guides and plurality of visors define a visor cartridge.

17. The helmet according to claim 16 wherein the visor cartridge is removable from the helmet.

18. The helmet according to claim 16 wherein the plurality of visors are removable from the visor cartridge.

19. The helmet of claim 1, comprising at least two said side guides, wherein said front guides are connected to and continuous with said side guides.

20. A helmet comprising:

a curved solid protective member shaped to cover portions of a human head, wherein said protective member has a top portion, side portions, a back portion, an interior, an exterior, and a facial opening;

at least one front guide laterally affixed to the protective member along said facial opening;

at least one side guide laterally affixed around one said side portion; and a visor engaged in said guides so as to be laterally moveable along said guide or guides back and forth between retracted and closed positions, wherein said visor covers said facial opening when laterally moved to said closed position, said side guide extending a sufficient distance around said side portion guide substantially the entire width of said visor around said side portion and substantially out of said facial opening when moved to said retracted position.

21. The helmet according to claim 20 wherein the side guide extends within the interior of said solid protective member.

22. The helmet according to claim 20 wherein the side guide extends around the outside of said solid protective member.

23. The helmet according to claim 20 wherein the side guide is integrated into said solid protective member.

24. The helmet according to claim 20 wherein the guides and visor define a visor cartridge.

25. The helmet according to claim 24 wherein the visor cartridge is removable from the helmet.

26. The helmet according to claim 24 wherein the visor is removable from the visor cartridge.

27. The helmet according to claim 20 wherein a plurality of visors are associated with the guide.

28. The helmet of claim 20, wherein said front guide is connected to and continuous with said side guide.

29. A protective head covering comprising:

a hard shell casing covering the sides, back, chin and crown of the human head, leaving the facial area exposed;

a pair of guides having grooves therein and extending completely around the interior of the hard shell casing, said guides being attached to the hard shell casing substantially parallel to each other and proximate to the top and bottom of the facial area; and a plurality of flexible transparent visors, wherein said visors extend within the grooves to allow bi-directional lateral movement of the visors along the guides in the hard shell casing.

* * * * *

UNITED STATES PATENT AND TRADEMARK OFFICE

CERTIFICATE OF CORRECTION

PATENT NO. : 5,477,566

DATED : Dec. 26, 1995

INVENTOR(S) : Massman

It is certified that error appears in the above-indentified patent and that said Letters Patent is hereby corrected as shown below:

Column 8, line 1, after "affixed around," please insert --at least--

Column 8, line 9, after "said side portion," please insert --to--.

Signed and Sealed this

Twenty-third Day of July, 1996

*Attest:*

Bruce Lehman

BRUCE LEHMAN

*Attesting Officer*

*Commissioner of Patents and Trademarks*